US008358801B2

(12) United States Patent
Vincent et al.

(10) Patent No.: US 8,358,801 B2
(45) Date of Patent: Jan. 22, 2013

(54) MAGNETIC CIRCUIT FOR ELECTRODYNAMIC MOVING VOICE COIL ACTUATORS

(75) Inventors: Stephen Saint Vincent, Ames, IA (US); Robert Katz, Montreal (CA)

(73) Assignee: Robert Katz, Montreal Quebec (CA)

( * ) Notice: Subject to any disclaimer, the term of this patent is extended or adjusted under 35 U.S.C. 154(b) by 1324 days.

(21) Appl. No.: 12/069,378

(22) Filed: Feb. 8, 2008

(65) Prior Publication Data

US 2008/0205687 A1 Aug. 28, 2008

Related U.S. Application Data

(60) Provisional application No. 60/900,699, filed on Feb. 12, 2007.

(51) Int. Cl.
*H04R 1/00* (2006.01)

(52) U.S. Cl. ..... 381/396

(58) Field of Classification Search ..... 381/396
See application file for complete search history.

(56) References Cited

U.S. PATENT DOCUMENTS

| | | | | |
|---|---|---|---|---|
| 2,341,275 | A | | 2/1944 | Holland |
| 2,698,917 | A | | 1/1955 | Van Urk et al. |
| 3,524,027 | A | | 8/1970 | Thurston et al. |
| 3,609,253 | A | | 9/1971 | Ashworth |
| 3,728,497 | A | | 4/1973 | Komatsu |
| 4,297,537 | A | | 10/1981 | Babb |
| 4,550,428 | A | * | 10/1985 | Yanagishima et al. ..... 381/86 |
| 4,951,270 | A | | 8/1990 | Andrews |
| 5,335,284 | A | | 8/1994 | Lemons |
| 5,390,257 | A | | 2/1995 | Oslac et al. |
| 5,473,700 | A | | 12/1995 | Fenner, Jr. |
| 5,536,984 | A | * | 7/1996 | Stuart et al. ..... 310/13 |
| 2006/0126886 | A1 | * | 6/2006 | Combest ..... 381/401 |
| 2006/0239496 | A1 | * | 10/2006 | Stiles et al. ..... 381/396 |

* cited by examiner

*Primary Examiner* — Charles Garber
*Assistant Examiner* — Andre' C Stevenson
(74) *Attorney, Agent, or Firm* — Camille L. Urban; David M. Breiner

(57) ABSTRACT

The invention is a novel circuit wherein maximum shove is achieved yet the transducer's height profile is minimized. The profile is minimized by using mated beveled surfaces on an annular magnet and the top plate which prevents the top plate from reaching saturation and reduces the reluctance f the magnetic flux path. A novel anti-fringe geometry to reduce flux leakage and net saturation in the center post improves the magnetic reluctance of the circuit. An external housing assembly is provided with integral suspension elements for radial stiffness and axial compliance and for aligning the circuit within the housing to prevent cocking and resulting distortion.

15 Claims, 6 Drawing Sheets

MAGNETIC CIRCUIT FOR ELECTRODYNAMIC MOVING VOICE COIL ACTUATORS

This application claims the benefit of the priority date of the provisional application Application No. 60/900,699 filed Feb. 12, 2007.

BACKGROUND OF THE INVENTION

1. Field of the Invention

The present invention relates generally to electrodynamic, moving voice coil actuators capable of converting energy between electrical and mechanical form and, more particularly, to a diaphragm loudspeaker and momentum or inertial type voice coil actuators that utilize a high energy axially polarized biasing magnet and a multi-component suspension for alignment of the moving coil.

2. Background of Invention

Loudspeakers and momentum type transducers historically have utilized two basic electrodynamic structures based upon a magnetic circuit described in U.S. Pat. No. 2,698,917 (A. T. Van Urk, et al) which describes the use of a ferromagnet having a substantially flat, thin permanent magnet, where the smallest dimension of the magnet is parallel with the direction of magnetization. Of the two most basic descriptions of the substantially flat magnet, the most common is the use of an annular magnet adjacent to a bottom plate with a center post to form one magnetic pole and a top plate with a central hole, creating an annular air gap with the center post to form the second magnetic pole. The second basic description is a disk shaped magnet without a central aperture that has a first pole defined as a top plate having the same as or larger diameter than the magnet, and a second pole formed by a pot type structure where the magnet is centrally aligned with the pot and an annular airgap is formed between the upper edge of the pot and the magnetic top plate.

The annular magnet type electrodynamic motor structure has found a very wide use because the magnet material is inexpensive, and because of the fact that assembly and magnetization are simple to accomplish. However, this design has significant drawbacks. The magnetic leakage flux at the outer edge of the magnetic assembly is strong. When this structure is placed near a CRT or Plasma type video display, the display equipment is degraded. Further, the low magnetic flux output of the ferromagnetic material requires substantial cross-sectional area of the magnet system (transversely to the axis of symmetry). The resulting requisite large physical dimensions are problematic for many new product design considerations.

The pot type magnetic structure gained significant commercial viability with the introduction of rare earth magnets, primarily those containing Neodymium, Iron and Boron. U.S. Pat. No. 5,390,257 (Oslac, et al) describes a system which is based on an axially magnetized, coin or disk-shaped magnet, usually of NdFeB material. The high flux capacity of the NdFeB magnet enables reasonable efficiency with the magnet contained within the voice coil dimension. However, since the area of the magnet is limited by the coil diameter, it is also limited how large magnetic flux can be obtained. Further, it is common to add an axial hole centrally through the assembly to obtain ventilation and this addition will reduce the magnetic flux, overall efficiency, and bandwidth. On the positive side, the system has a moderate depth and cross-sectional area in relation to the coil diameter, something which is very advantageous in some applications.

As is well known in the art, the force generated by an electrodynamic transducer is a product of the current, I, length of coil wire, L and flux density, B so that $F=iL\otimes B$. The length of the coil wire that is within the annular magnetic gap is defined as the length, L. This force is what creates the movement of the coil and subsequently generates sound. Building on this concept, inertial voice coil actuators have been used to acoustically stimulate semi-rigid structures to radiate sound. In this application, voice coil actuators have been attached to structures that are relatively large to act as a soundboard e.g. a wall in a room. The wall of the room, when acoustically driven, radiates sound. As is well known in the art, the force generated by an electrodynamic transducer is a product of the current, I, length of coil wire, L and flux density, B so that $F=iL\otimes B$. The length of the coil wire that is within the annular magnetic gap is defined as the length, L. This force is what creates the movement of the coil and subsequently generates sound.

A number of inventions for voice coil actuators have been patented among them U.S. Pat. No. 2,341,275 to Holland for Sound Reproducing Instrument; U.S. Pat. No. 3,609,253 for Loudspeaker with Improved Voice Coil Suspension; U.S. Pat. No. 3,728,497 to Komatsu for Dynamic Loudspeaker Using Wall as Diaphragm; U.S. Pat. No. 4,297,537 to Babb for Dynamic Loudspeaker; U.S. Pat. No. 4,951,270 for Audio Transducer Apparatus; U.S. Pat. No. 5,335,284 to Lemons for Coneless, No-Moving-Parts Speaker; and U.S. Pat. No. 5,473,700 Fenner, Jr. for High Gain Transducer and U.S. Pat. No. 3,524,027 to Thurston, et al.

It is known to employ a compliant suspension structure formed in the base wall of a momentum type transducer that is in closest proximity to the soundboard. At the centerline of the base wall is either a threaded insert or protruding threaded bolt. The momentum transducer is then cantilevered off a threaded rod which is mechanically attached to the soundboard. Two problems arise with this design; it significantly increases the transducer's standoff height and profile and, further, forces acting normal to the protruding threaded element are amplified such that they may cause structural failure in the mechanical attachment.

In practice, the annular magnet, magnetizable plates, external housing and structural attachment point as presently known in the art, comprise a system that is large and heavy relative to the total dynamic force the actuator is capable of generating. If the external housing is mounted on a vertical facing surface such as a wall, large bending moments will be placed on the structural attachment point which may be translated to the coil. In sum, the present state of the art provides electrodynamic transducers that are plagued with well known problems of low power handling, limited frequency response, high levels of sound distortion, substantial size and mass, mechanical complexity and high production costs.

Recent innovations include magnetic materials that have produced magnets with substantially greater magnetic energy than ceramic magnets. These magnets have necessitated the redesign of the magnetic circuit to take advantage of the higher magnetizing flux while reducing the volume of the magnet material consumed, thus reducing its size while simultaneously increasing its force density per unit volume. However, these prior art voice coil actuators are not typically designed with suspension systems adequate for actuators driving relatively large structures such as walls and their application in those contexts results in some of the same short falls as was previously known, especially relative to sound quality and distortions.

SUMMARY OF THE INVENTION

What was needed was a voice coil actuator capable of driving large soundboards without sound distortion, but with high efficiency and lower profile.

It is an object of this invention to provide a novel magnetic circuit where a high magnetic flux density is projected across an extended height airgap, but which also results in a relatively lower profile.

It is a further objective of this invention to provide a novel magnetic circuit as used to mechanically displace a loudspeaker diaphragm.

It is therefore an object of this invention to provide a momentum type acoustic transducer for acoustic communication with acoustic soundboards having improved frequency response, and increased efficiency.

A further object of the invention is to provide a low profile transducer that is suitable for mounting in applications requiring reduced transducer height.

A further objective of the invention is to provide a means of simple and reliable mechanical and acoustic coupling with associated soundboard.

Yet a further objective of the invention is to provide a means for improved frequency response, higher efficiency, and adequate suspension to minimize distortion that results from voice coil buzz and rub.

Continued advancement in the development of high energy magnetic materials, particularly those magnets comprised of Neodymium, Boron and Iron are requiring novel configurations. As commercially available permanent magnets improve their maximum magnetic energy product (Residual Induction ($B_r$) times Coersivity ($H_c$), also known as the BH product) the present state of the art magnetic circuits do not support the realization of the full potential of these materials. The present invention discloses arrangements and characteristics of the magnet, top plate, center post and bottom plate to maximize the magnetic flux transversing the annular magnetic gap wherein is disposed an electrically conductive voice coil wound on a voice coil former.

Magnetic circuit configurations where the magnet is disposed within the voice coil are at a distinct disadvantage in that as the magnetic flux lines propagate radially outward to the airgap, the flux density is reduced by simple geometric diffusion. Disposing the magnet outside the voice coil by contrast realizes an increase in the magnetic flux lines as they propagate toward the center post. The limitation of the flux density is constrained by the concentrating magnetic flux, saturating either the top plate, center post or bottom plate.

As the components carrying the magnetic flux approach saturation, the magnetic permeability is reduced, reducing the flux density across the airgap. The present invention introduces two innovations in the magnetic circuit. First, the magnet and top plate are coincidentally beveled to prevent the top plate from reaching magnetic saturation. And, second, a modified anti-fringe geometry is employed that simultaneously reduces flux leakage from the airgap and reduces the net volume of magnetic saturation in the center post, thereby improving the magnetic reluctance of the total circuit.

The present invention proposes a novel magnetic circuit wherein an axially polarized annular high energy permanent magnet is disposed between a bottom plate and a top plate, each suitable for carrying magnetic flux. The bottom plate has a center post with an outside surface and an anti fringing groove. The permanent annular magnet includes a chamfer or fillet between the magnet's top surface and inner diameter surface, an outer surface, and a bottom surface; and a center aperture through which the center post is positioned. The annular magnet is axially polarized relative to the center post and the chamfer between the inner diameter surface and top surface of the permanent magnet is not parallel to the outer surface. The top plate has an upper surface, an outer surface and a bottom surface. The bottom surface of the top plate is in intimate contact with the magnet's top surface and adjacent the inner diameter surface. An inner surface of the top place forms an annular opening somewhat larger than the diameter of the post, such that an annular magnetic gap is formed between the post and the inner surface of the annular opening of the top plate. An electrically conductive voice coil is disposed within the annular magnetic gap and thereby positioned between the center post and the inner surface of the annular opening of the top plate.

The chamfer located between the top surface and inner surface of the high energy permanent annular magnet is mated with a corresponding bevel or chamfer on the outer surface of the top plate. Those skilled in the art will recognize that bevel can be approximated or substituted with a series of steps or a fillet of continuous or fillet of variable radius.

The outside surface of the center post is divided into an upper portion which forms one wall of the magnetic gap and a lower portion. The lower portion has a groove cut below the magnetic gap where the circumference of the post gradually increases toward the bottom plate. This arrangement creates an anti-fringing groove.

Increasing the efficiency of a moving voice coil transducer is realized by increasing the shove factor; ($BL/\sqrt{R_{DC}}$), where BL is the product of the magnetic flux |B| across the airgap and the Length (L) of the electrically conductive coil in the airgap and R is the DC electrical resistance of the electrically conductive voice coil. The high BH product permanent magnetic materials enable increase shove factor electrodynamic motors by realizing increased magnetic flux |B| across the airgap and L by increased airgap height.

Increasing the airgap height will necessarily reduce the magnitude of the magnetic flux |B| in the airgap so the magnetic flux |B| is maximized by improving the magnetic reluctance of the total flux path.

In the present invention this objective is achieved by further enhancement of the magnetic flux |B| across the airgap. The enhancement is realized by making the inner surface of the annular permanent magnet a bevel between the top and bottom surfaces of the associated magnet. The mating surface of the top plate has the same beveled contour to cause the magnetic flux |B| to be uniform along the height of the airgap. The bevel interface between the top plate and the annular permanent magnet reduces the assembly stack height of the magnetic circuit while also reducing the reluctance of the magnetic flux path.

A further enhancement of the magnetic circuit is the placement of the magnetic anti-fringing groove on the center post outside surface. The center post outer surface in the region of the airgap is parallel to the center line axis of the center post. Between the airgap region and the bottom plate, a groove is cut into the center post to preferentially influence the magnetic flux |B| to propagate between the top plate inner diameter and the center post. The groove is then tapered by increasing the post diameter to reduce the net volume of magnetic material operating at or near magnetic saturation. The average magnetic permeability of the total flux path is increased, which, in turn increases the magnetic flux |B| across the airgap.

Those skilled in the art will recognize that the electrical resistance of the electrically conductive coil can be minimized by selecting appropriate wire gauge, turns and layers of the electrically conductive coil. Further, those skilled in the art will recognize that the application of a highly electrically conductive cap or shunt ring over the center post and other magnetic circuit components may be utilized to limit the inductive coupling between the electrically conductive coil and the magnetic circuit.

Momentum type acoustic transducers typically integrate an external housing that provides for the following functions: fixedly supports the magnetic structure relative to a moving coil for proper alignment of the moving coil within the magnetic air gap of the magnetic structure, provides a compliant suspension element that will permit the voice coil to move axially along the centerline of the moving voice coil and the magnetic structure, and provides a means for mechanically coupling the dynamic forces of the voice coil to a soundboard.

The low profile momentum type transducer of the present invention features an external housing assembly with an integral suspension element to provide radial stiffness and axial compliance on the inertial reaction mass portion of the magnetic circuit. The assembly further includes a retained bearing to provide a radial stiffness for voice coil alignment within the magnetic air gap of the magnetic circuit, an acoustic output and a mechanical attachment disk. In another embodiment the bearing is replaced by a surround suspension sometimes know in the art as a spider. The surround suspension may be attached to the top plate and to the housing or other supports on the outside diameter.

The preferred embodiment of the momentum type voice coil actuator of the present invention includes a housing assembly with integral suspension consisting of a flexural element and a bearing retained in the housing for aligning the voice coil with the magnetic air gap and an integrated mechanical output that mates with a matching receiver. The preferred embodiment includes tabs or rings specifically positioned to facilitate accurate alignment of the magnetic circuit and a tongue and groove arrangement to associate the housing assembly with an output disk. The housing assembly is preferably provided with a counter sunk hole aligned with a threaded hole to affix the housing assembly to the magnetic circuit.

The magnetic circuit contemplated for improvement by the flexural element may be as simple as an axially aligned circuit having a magnet structure, a magnetic gap, a coil, and a housing assembly. The flexural bearing permits limited displacement of the housing while generally maintaining the axial alignment of the circuit.

The preferred embodiment also includes an integrated mounting apparatus comprising an output disk and a receiver designed to interlock one with the other in such a way as to accurately translate the vibrations without attenuation or distortion to a sound body. One way of accomplishing these objectives uses an interlocking mechanism which comprises at least one helically arranged wedge on the output disk and at least one complementary engagement opening on the receiver. In operation, the wedges on the output disk are positioned to be in communication with a base formed in the receiver thereby providing accurate transmission of vibrations. In the preferred embodiment the output disk further registers into the receiver rotationally via pins, tabs or other registration means which assist in placement of the engagement wedge on the wall of the receiver. The output disk can then be rotated and pressured into the receiver. There is a locking means that will hold the output disk in its downward pressured position against the receiver in order to accurately transmit vibrations and forces created by the voice coil actuator to the receiver, and then through the receiver to the substrate or soundboard.

To evenly distribute the downward pressure forces between the output disk and the receiver exerted by the helical interface, the distal surface of the output disk can be molded with a very slight convexity. When pressured into the receiver by the helical means on the output disk, the output disk would compress downward, flattening the convexity of the outer surface rendering it flat and causing even forces to propagate throughout the surface.

Adhesive or conventional fixative means may be used to acoustically couple the receiver and the soundboard. No adhesives between the output disk and receiver are necessary. This mounting arrangement is particularly useful when the voice coil actuator is to remain exposed and minimizes the need for tools and time for assembly, installation, and repair.

Those skilled in the art will recognize that improvement in the power handling can be realized by the addition of a magnetic fluid in the form of low viscosity oil, having microscopic ferrous particles such as magnetite, homogeneously suspended in the fluid. The oil-magnetic emulsion is attracted to and held in the magnetic field within the magnetic gap by reason of the magnetic flux across this gap. The magnetic particles hold the liquid phase of the oil within the gap. The viscous magnetic fluid provides a heat dissipating mechanism and a radial restoring force when the voice coil is radially displaced. The restoring force is a result of an unbalanced magnetic force in the fluid when the fluid is not symmetrically displaced within the magnetic gap and coil former. The radial restoring force is typically sufficient to support the mass of the magnetic circuit when its axis is parallel to a horizontal orientation. In the event of substantially larger radial forces that will overcome the radial restoring force of the viscous magnetic fluid, the antifriction bearing acts as a back-up bearing for the voice coil former.

A cone speaker of the present invention includes the additional assembly of a basket assembly, cone diaphragm, suspension surround between the associated basket and cone, spider suspension between the cone and the basket, dust cap covering coil and the cone. Those skilled in the art will recognize that other components and materials may be utilized as well.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF PREFERRED EMBODIMENT

Figure 1:
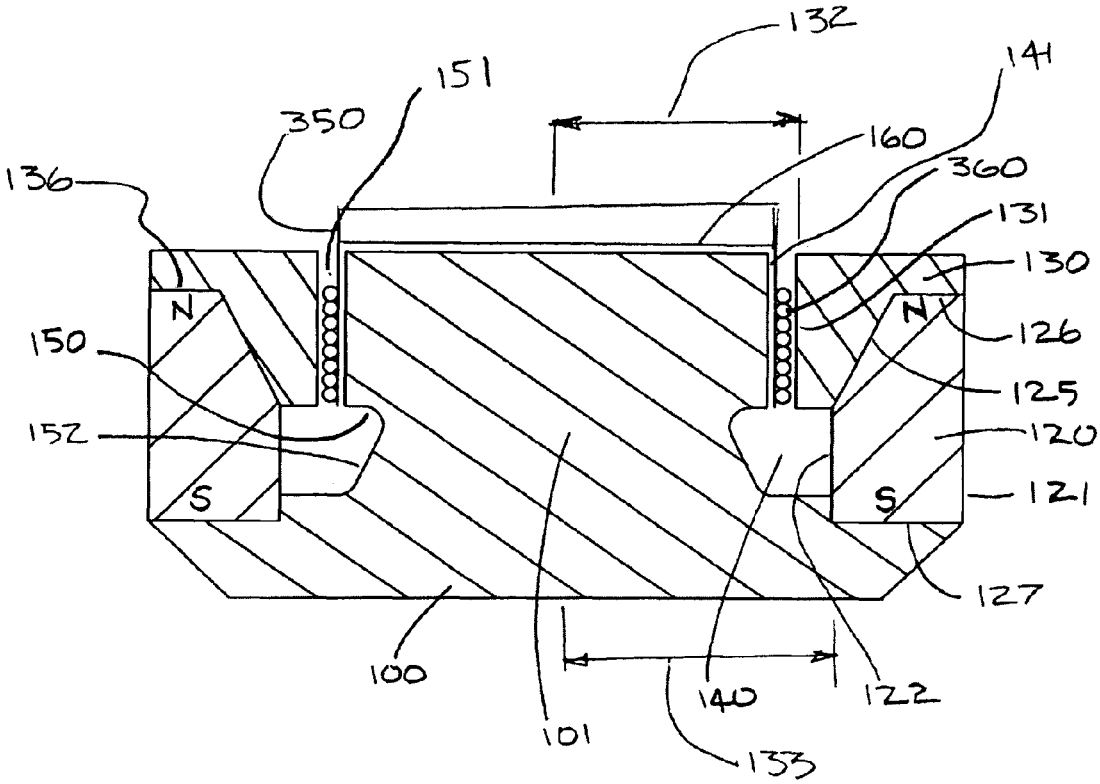
FIG. 1 is a cross sectional view of the improved magnetic circuit.

A cross-sectional view of the present invention is illustrated in FIG. 1. The illustration presents the present invention of the improved magnetic circuit 10 as a cross section of a body of revolution. The magnetic circuit consists of a bottom plate 100 with a center post 101 having a first surface 141 forming a proximal wall of an air gap 151, and an anti-fringe groove 150. In the preferred embodiment the groove 150 is characterized by an undercut radius and a taper section 152 between the base of the airgap 151 and the bottom plate 100. An annular permanent magnet 120 has an inner surface 122, a bottom surface 127, an outer surface 121, a top surface 126 and a beveled surface 125. The bevel surface 125 forms a conical taper which has its central axis coincident with the center line axis of the bottom plate 100. A top plate 130 has an inner surface 131 with a radial dimension 132 that forms the distal wall of the airgap 151, a bottom land 136 that mates with the top surface 126 of the permanent magnet 120, and a beveled interface 135 that is coincident with the bevel 125 of the permanent magnet 120. The inner surface 122 of the permanent magnet 120 comprises a radial dimension 133 larger than the radial dimension 132 of the top plate 130 forming the distal wall of the air gap 151. Those skilled in the art of loudspeaker design will recognize that improvement in the frequency response of the motor can be realized by incorporating means for electro-magnetically decoupling the AC magnetic field generated by an electrically conductive coil 360 from the top plate 130, bottom plate 100 and center post 101 by a cap 160 comprised of high electrical conductivity material. Additionally, power handling performance of the magnetic circuit can be improved by application of a magnetic fluid within the airgap 151.

Figure 2A:
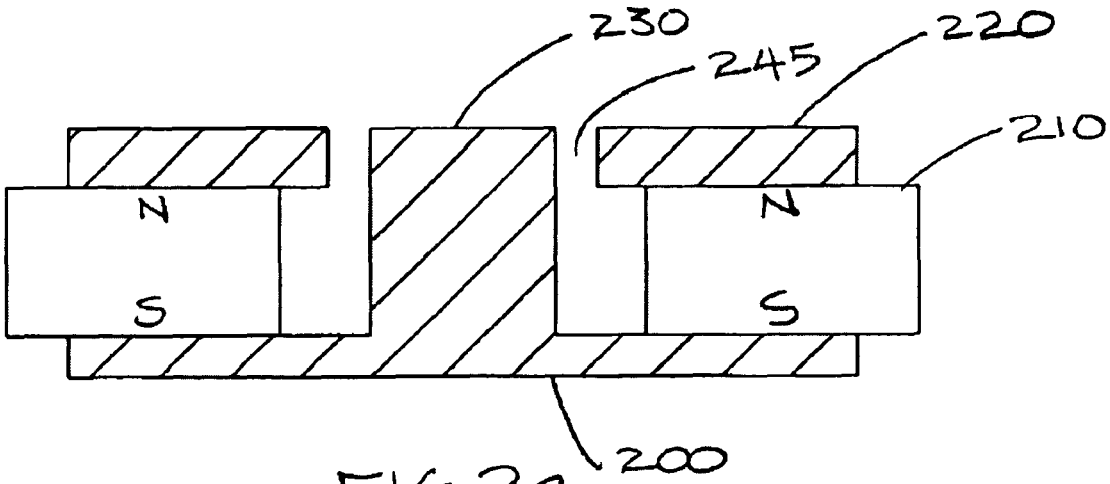
FIG. 2a PRIOR ART
FIGS. 2*a* and 2*b* is a illustration of magnetic circuits of prior art.
Figure 2B:
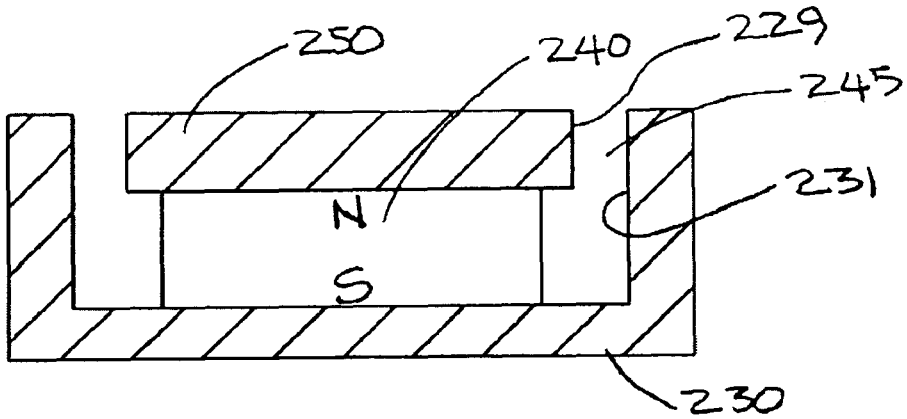
FIG. 2b PRIOR ART

For comparison purposes, prior art magnetic structures are shown in FIGS. 2*a* and 2*b*. The characteristic Ferro-magnet magnetic structure is shown in FIG. 2*a* where the annular magnet 210 with a central aperture is mounted to a bottom plate 200 comprising a center post 230. The center post 230 and magnetic top plate 220 form an annular airgap 245. A pot type magnetic structure utilizing a disk shaped permanent magnet is shown in FIG. 2*b*. A disked shaped magnet 240 is disposed on a bottom plate with cylindrical walls 230, forming the distal wall 231 of a magnetic air gap 245. A magnetic top plate 250 is disposed atop the disked shaped magnet 240. The outer edge of the top plate forms the proximal wall 229 of the magnetic circuit airgap 245.

Figure 3:
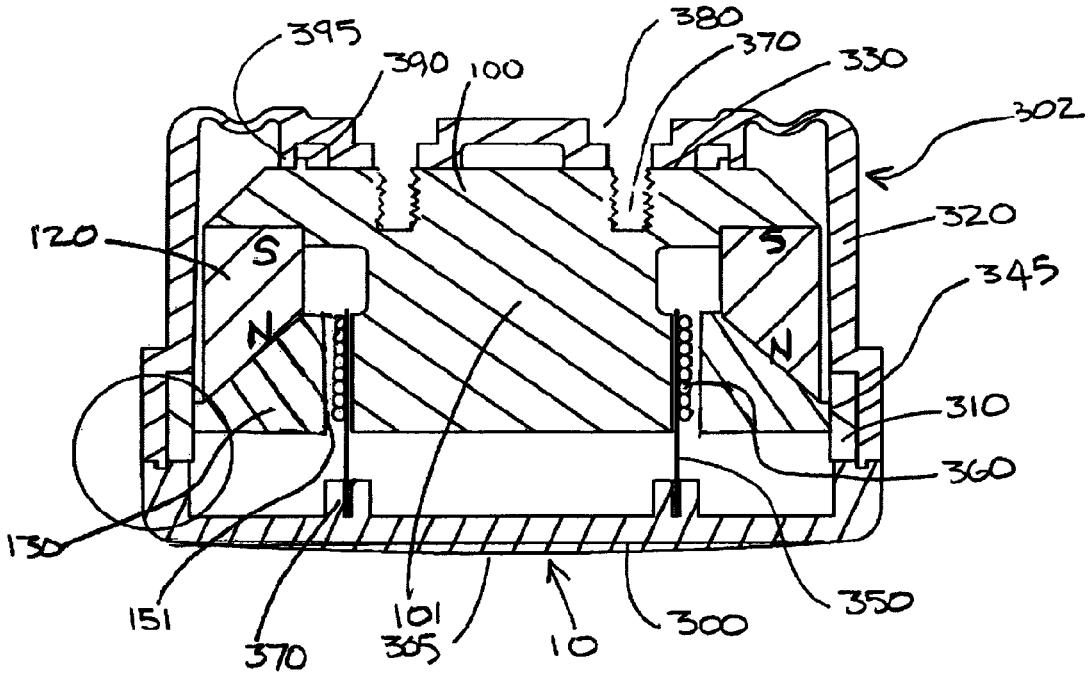
FIG. 3 is a cross sectional view of the improved magnetic circuit as utilized in a momentum type transducer.
Figure 7:
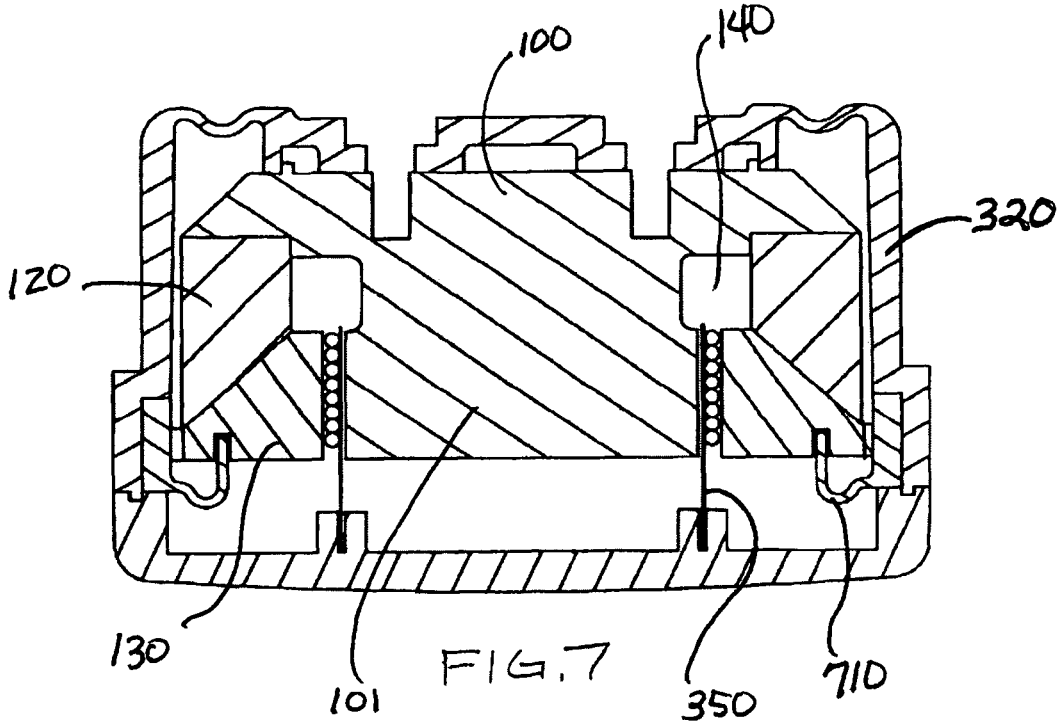
FIG. 7 is a cross sectional view of a second embodiment of the circuit employing a surround suspension.

FIG. 3 is a depiction of the improved magnetic circuit 10 described in FIG. 1 which is utilized within low profile momentum type acoustic transducer. The low profile momentum transducer comprises a housing assembly 302 having an integral housing 320 and an acoustically active output disk 300. Means for attaching said output disk 300 and said integral housing 320 are provided and may include bonding. Preferably, an annular groove 370 is formed on the internal side of the output disk 300 positioned to radially align a coil former 350 with the air gap 151 in the improved magnetic circuit 10. An electrically conductive coil 360 is wound on the coil former 350. The electrically conductive coil winding 360 is positioned mid height of the airgap 151. A radial bearing surface 345 extends beyond the outer diameter of the permanent magnet 120 to contact means for preventing the circuit from cocking 310 relative to said coil former 350. Said means for preventing the circuit from cocking may comprise a low friction bearing 310. In another embodiment the low friction bearing 310 may be replaced by a means for surround suspension 710 (See FIG. 7). As is known in the art, a spider may be employed as means for surround suspension. Said means for surround suspension is associated with the top plate 130 and the integral housing 320.

Preferentially, the low friction bearing 310 is positioned between and stabilized by the integral housing 320 and the output disk 300, however, the bearing 310 may be otherwise located and or secured. The low friction bearing 310 prevents the improved magnetic circuit 10 from cocking relative to the voice coil former 350. The invention further provides means for aligning the circuit and the housing 329. Said means 329 may comprise one or several different elements, combined or alone. In the preferred embodiment, said means for aligning includes a flexural bearing 330, a countersunk hole 380, and at least one threaded hole in the center post 101. The bearing 330 may or may not be integral with housing 320 permits axial compliance yet retains radial stiffness. The countersunk hole 380 is formed in the housing 320 to permit a mechanical fastener (not shown) to fixedly attach the housing 320 to the improved magnetic circuit 340. The hole 370 is aligned with the molded countersunk hole 380 for aligning the housing 320 and the bottom plate 100 to minimize distortion. In an even more preferred embodiment, means to align 329 includes an annular alignment ring 390 formed in the first surface (or attached thereto) of the magnetic bottom plate 100 and a corresponding alignment ring 395 formed (or attached thereto) in the housing 320. When the two rings 390 and 395 are aligned one is concentric to the other so that the improved magnetic circuit 340 is radially aligned with the housing 320. Although rings 390 and 395 are the preferred alignment mechanism, strategically aligned tabs and/or slots and other means may be used.

Figure 4:
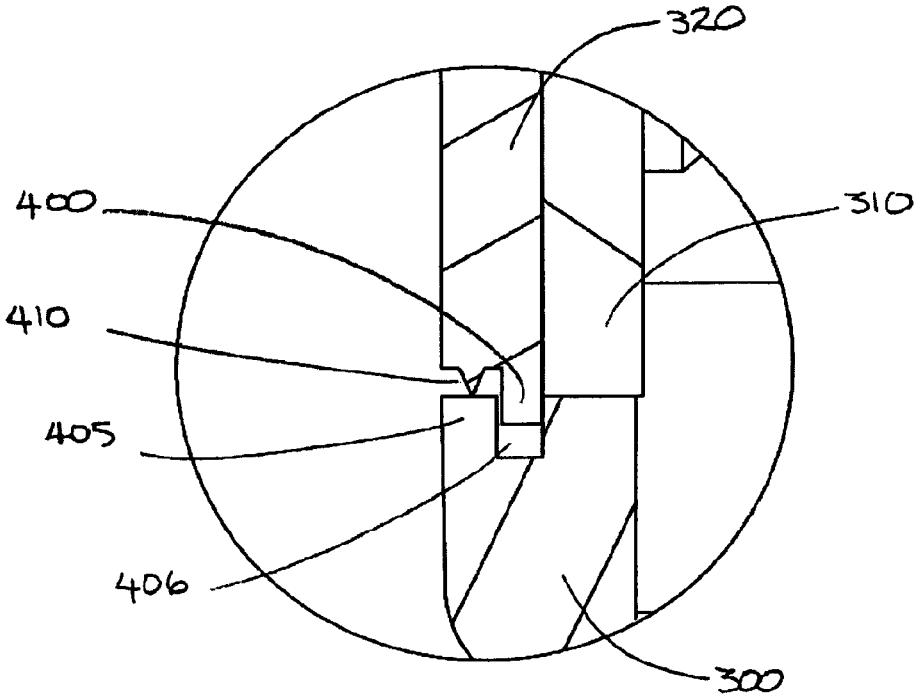
FIG. 4 is a detailed view of the momentum type transducer housing to disk.

The preferred embodiment of attaching the housing assembly 302 to the acoustic output disk 300 is shown in greater detail in FIG. 4. An annular rabbet 405 and groove 406 is formed in the output disk 300 that correspondingly aligns with an annular tongue 400 formed in the housing 320. The annular tongue 400 and rabbet 405, when mated, radially align the housing 320 and output disk 300. In the preferred embodiment, a Vee detail 410 is formed on the housing 320 so that when ultrasonic energy is applied, the Vee 410 melts, bonding and sealing the disk 300 to the housing 320.

Figure 5:
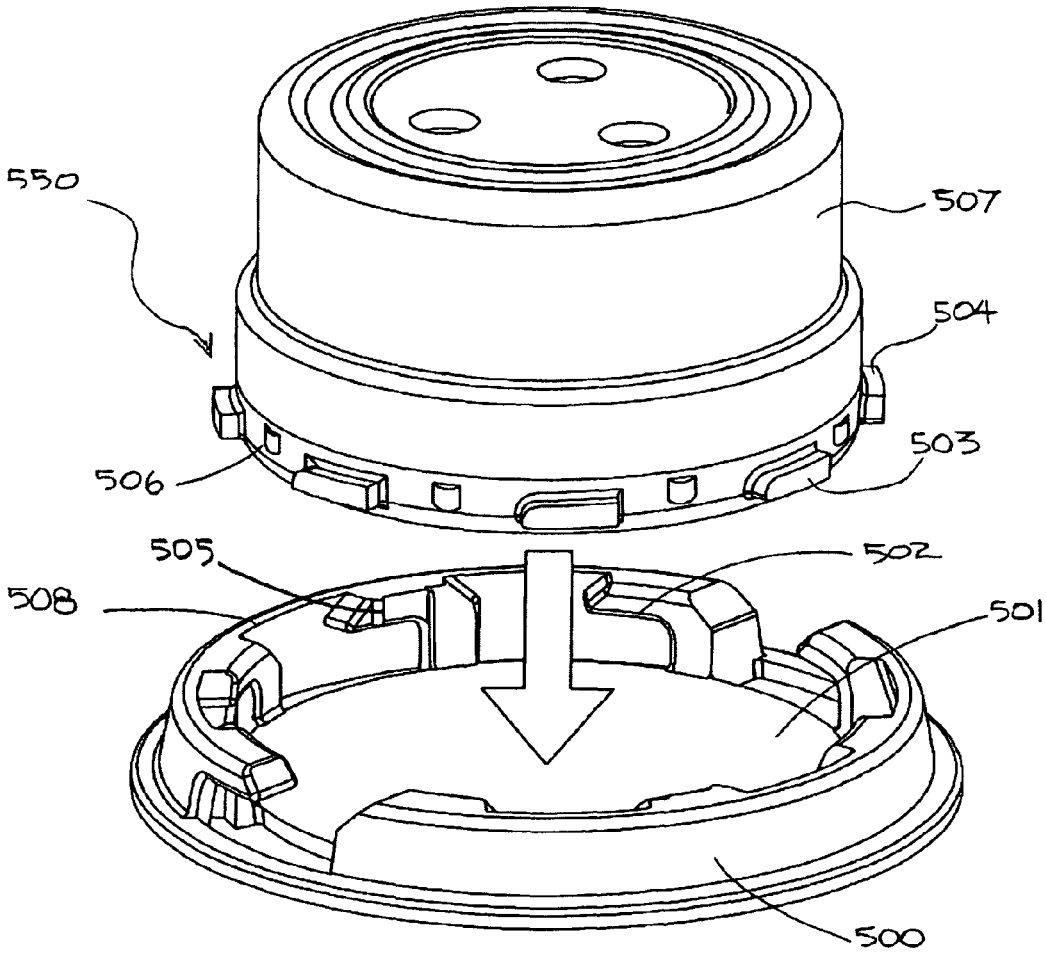
FIG. 5 is an isometric view of the momentum type transducer and its mounting plate.

The preferred embodiment includes an integrated mounting apparatus 550 illustrated in FIG. 5. For installation, a receiver 500 is mounted on a soundboard by conventional means. A plurality of wedges 503 are positioned on the output disk 300 on the momentum type transducer of FIG. 3. Each of said plurality of wedges 503 is aligned with one of a plurality of openings 508 on the receiver 500. The preferred openings 508 are helicoidal and include a surface 502. The momentum type transducer is moved toward the receiver 500 such that each of the plurality of engagement wedges 503 are in a position to rotationally engage each of said plurality of openings 508 and the surfaces 502. Next, the momentum type transducer is rotated a partial turn which frictionally engages the receiver 500 and the output disk 300 and serves to transmit sound vibrations as well as mount the unit on the soundboard. To evenly distribute the downward pressure forces between the output disk 300 and the receiver 500, the distal surface 305 of the output disk 300 can be convex as shown in FIG. 3. As the output disk 300 is compressed downward during installation, the convexity will flatten and disperse the downward forces more evenly.

In this preferred embodiment the output disk 300 is removably engaged to the receiver 500 using the plurality of wedges 503 and the plurality of openings 508. Of course, a similar objective may be accomplished with a single wedge and a single opening. As shown in FIG. 5 in order to secure the position of the momentum type transducer and to maintain positive contact between the output disk 300 and the receiver 500, the preferred embodiment includes a locking means comprising a rib 505 on the receiver 500 and a rib 506 on the output disk 300 are employed to prevent the output disk 300 from counter rotating and diminishing contact pressure between the output disk 300 and receiver 500. The ribs 505 and 506 override each other when the momentum type transducer is rotated within the receiver 500 which prevents the output disk from counter rotating. Applying sufficient counter torque to the momentum type transducer will cause the ribs 505 and 506 to override each other which then permit easy counter rotation of the momentum type transducer for easy removal.

Figure 6:
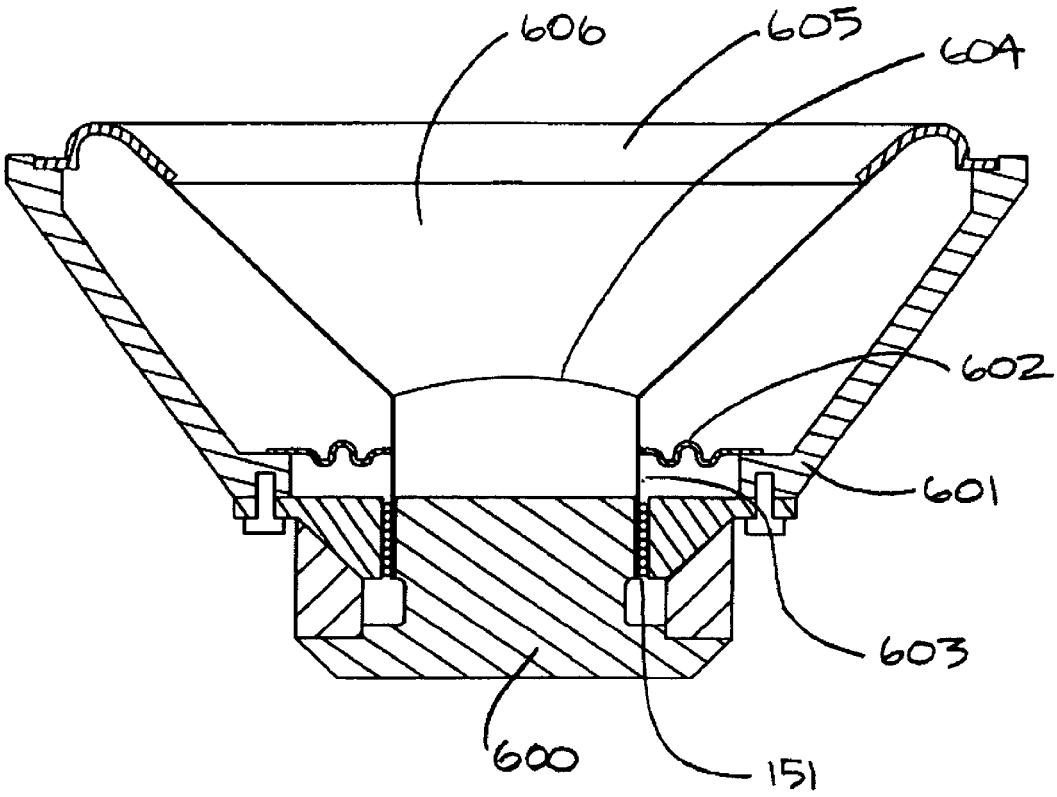
FIG. 6 is a cross sectional view of a cone type loudspeaker with the improved magnetic circuit.

FIG. 6 illustrates the improved magnetic circuit as applied to a conventional cone diaphragm loudspeaker. The improved magnetic circuit 10 (as illustrated in FIG. 1.) is mounted to a basket assembly 601. The basket assembly 601 has a surround suspension 605 affixed to the basket 601 and a cone diaphragm 606. The surround suspension 605 provides radial stiffness at the suspended end of the cone diaphragm 606 while supplying axial compliance permitting the cone diaphragm 606 to move axially within the total loudspeaker assembly. The cone diaphragm 606 is bonded to the voice coil former 350 to which the electrically conductive coil 360 is wound. The electrically conductive voice coil 360 is disposed within the magnetic airgap 151 in the improved magnetic circuit 10. A second suspension element 602 or multiple elements of the same, is affixed to the voice coil former 603 and the basket assembly 601. The second suspension element 602 provides radial stiffness, radially and axially aligning the voice coil former 350 within the magnetic airgap 151. The second suspension element(s) 602 also permits axial compliance, permitting the voice coil former 350 and coil 360 and the cone diaphragm 606 to move axially. A dust cover 604 is bonded to the central portion of the cone diaphragm 606 and/or the voice coil former 350 protecting the voice coil former 350 and magnetic airgap 151.

We claim:

1. An electromechanical transducer comprising (a) a magnetic circuit comprising a substantially axially aligned magnetic circuit and a hosing assembly, said housing assembly comprising a disk type surface and a flexural bearing associated with said disk type surface for permitting limited displacement of the housing assembly while generally retaining the substantially axial alignment of the magnetic circuit; and (b) a structure attached to the housing, the structure being configured to prevent the magnetic circuit from cocking, wherein the magnetic circuit comprising a magnet and a magnetic gap into which a coil is at least partially inserted wherein the coil and the magnet are between the flexural bearing and the output disk.

2. The electromechanical transducer according to claim 1, wherein the structure is a low friction bearing.

3. The electromechanical transducer according to claim 1, wherein the structure is a surround suspension.

4. The electromechanical transducer according to claim 1, wherein the surround suspension is a spider.

5. The electromechanical transducer according to claim 1, further comprising: an output disk.

6. The electromechanical transducer according to claim 5, wherein the structure is arranged near the output disk.

7. The electromechanical transducer according to claim 1, wherein structure is configured to contact a radial bearing surface which extends beyond an outer diameter of the magnet.

8. The electromechanical transducer according to claim 7, wherein the radial bearing surface is associated with a plate arranged near the magnet.

9. The electromechanical transducer according to claim 8, wherein the plate includes an inclined surface configured to engage an inclined surface of the magnet.

10. The electromechanical transducer according to claim 1, further comprising: a coil former around which the coil is wrapped.

11. The electromechanical transducer according to claim 10, further comprising: an output disc, wherein the coil former is attached to the output disc and the output disc is attached to the housing.

12. The electromechanical transducer according to claim 1, further comprising: an output disc, wherein the structure is arranged between the flexural bearing and the output disc.

13. The electromechanical transducer according to claim 12, wherein the structure is a low friction bearing.

14. The electromechanical transducer according to claim 12, wherein the structure is a surround suspension.

15. The electromechanical transducer according to claim 12, wherein the surround suspension is a spider.

* * * * *